United States Patent [19]

Buchner

[11] 4,223,512

[45] Sep. 23, 1980

[54] METHOD OF PACKAGING AND STERILIZING PRODUCTS

[75] Inventor: Norbert Buchner, Winnenden, Fed. Rep. of Germany

[73] Assignee: Robert Bosch GmbH, Stuttgart, Fed. Rep. of Germany

[21] Appl. No.: 963,709

[22] Filed: Nov. 27, 1978

[30] Foreign Application Priority Data

Nov. 29, 1977 [DE] Fed. Rep. of Germany ..... 2753177

[51] Int. Cl.[3] ..... B65B 55/02

[52] U.S. Cl. ..... 53/425; 53/453; 422/21

[58] Field of Search ..... 53/425, 426, 453, 449; 422/21

[56] References Cited

U.S. PATENT DOCUMENTS

| | | | |
|---|---|---|---|
| 2,447,258 | 8/1948 | Lobley | 53/449 X |
| 3,750,362 | 8/1973 | Kishpaugh et al. | 53/453 X |
| 3,809,845 | 5/1974 | Stenstrom | 422/21 |
| 3,942,299 | 3/1976 | Bory | 53/425 |

*Primary Examiner*—Travis S. McGehee

*Attorney, Agent, or Firm*—Edwin E. Greigg

[57] ABSTRACT

A method is proposed for packaging products, particularly food products, and sterilizing them in an alternating high-frequency electromagnetic field. The product is first introduced into trough-like, preferably interconnected containers provided with a metallic layer; then the containers are closed with a synthetic film, brought within the range of an alternating high-frequency electromagnetic field, and finally sealed with a foil having a metallic lamina which covers the synthetic film.

2 Claims, 1 Drawing Figure

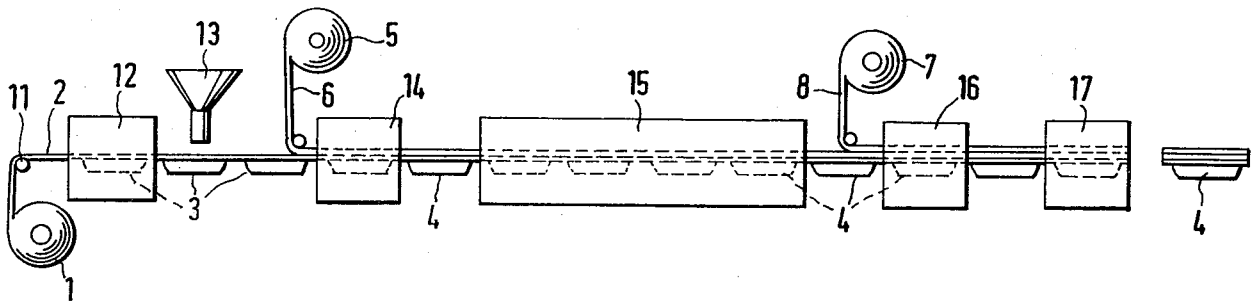
1
2
3
4
5
6
7
8
11
12
13
14
15
16
17

METHOD OF PACKAGING AND STERILIZING PRODUCTS

BACKGROUND OF THE INVENTION

The invention relates to a method for packaging products, particularly food products, and for sterilizing them in an alternating high-frequency elctromagnetic field. In a previously known method of this type, such as that disclosed in the German laid-open application 24 18 783, the liquid product is placed in a tube made of a synthetic film, then the tube is passed through a microwave field, which heats the product, and finally the tube is divided into envelope-like packages by the inclusion of a transverse seam, and the packages are separated by cutting through the transverse seam. In the known method, a synthetic packaging material is employed which has a low dielectric loss factor, which presents little resistance to the microwaves and permits them to penetrate into the filling. Packages which are produced in this manner, however, have a shorter shelf life, i.e., keeping capacity of durability, as compared with packages made of metal, because the synthetic film used has a higher permeability to gases.

OBJECT AND SUMMARY OF THE INVENTION

The method according to the invention has the advantage that a packaging material may be employed which has a metallic layer which lends the package a considerably longer shelf life. The synthetic film, which is first placed on the container as a means for closing it, permits the passage of the containers through the treatment apparatus in other than a horizontal direction.

The invention will be better understood as well as further objects and advantages thereof become more apparent from the ensuing detailed description of preferred embodiments taken in conjunction with the drawing.

BRIEF DESCRIPTION OF THE DRAWING

One exemplary embodiment to perform the method according to the invention is represented in simplified form in the drawing and will be further described below.

DESCRIPTION OF THE PREFERRED EMBODIMENT

The illustrated embodiment shows an apparatus for producing, filling, closing, and sterilizing packages. A sheet of packaging material 2 is cyclically drawn from a supply roll 1 over a deflection roller 11, with the packaging material sheet 2 comprising a composite of aluminum and synthetic material. The sheet 2 is first delivered to a forming apparatus 12, in which one or more troughs 3 are formed in the packaging material sheet 2. After being advanced one or more steps, a portion of the food product to be packaged is placed into each of the troughs 3 by a filling apparatus 13. Then the troughs 3, which have a projecting flange on their open side, with which they are interconnected in a chain-like fashion, are covered by a film 6 delivered by a supply roll 5. The film 6, which comprises a synthetic with a low dielectric loss factor, is sealed at a sealing station 14 to the flange of the troughs 3. The sealing seam may be interrupted so that gases which form in the package 4 may escape.

The packages 4 produced in this way are thereafter passed through a microwave apparatus 15, in which an alternating high-frequency electromagnetic field is generated between electrodes. In this field, the product introduced into the troughs 3 is quickly heated to sterilization temperature. After sterilization, the packages 4 are sealed in a sealing apparatus 16 with a heat-sealable layered aluminum foil 8 delivered by a supply roll 7. The aluminum foil 8 covers the synthetic film 6 which was previously placed on the troughs 3, and is likewise sealed to the projecting flange of the troughs 3, however without any interruption, so that the necessary level of oxygen impermeability is attained. Then the packages 4 are separated into individual items at a subsequent stamping apparatus 17 by means of an appropriate cutting or stamping operation.

It is further noted that a cooling path may be attached to the microwave sterilization apparatus, which the packages pass through while still hot, before the impermeable sealing foil 8 is placed over and sealed onto the offstanding flanged area. It will also be understood that the microwave apparatus may also be equipped with a pressure chamber in which the packages are heated and then cooled again.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A method for packaging products, particularly food products, and for sterilizing them in an alternating high-frequency electromagnetic field, comprising the steps of:

forming a traveling laminate having a metallic layer into a container to provide a trough-like area into which a product is to be introduced;

advancing the formed container past a product discharge point to deposit a predetermined quantity of said product into said container;

covering the container with a synthetic film introduced thereover from a traveling web;

moving the containers seriatim through a high-frequency microwave field and applying a sealing layer of a metallic foil over the synthetic film.

2. A method in accordance with claim 1, the further step wherein the trough-like containers are subjected to the individual treatment steps as an interconnected chain.

* * * * *